US008438986B2

(12) United States Patent
Haller et al.

(10) Patent No.: US 8,438,986 B2
(45) Date of Patent: May 14, 2013

(54) HYBRID INFLATABLE KAYAK

(75) Inventors: Clayton F. Haller, Concord, CA (US); Charles Hall, Bainbridge, WA (US); Ryan Pugh, Concord, CA (US)

(73) Assignee: Advanced Elements, Inc., Benicia, CA (US)

( * ) Notice: Subject to any disclaimer, the term of this patent is extended or adjusted under 35 U.S.C. 154(b) by 21 days.

(21) Appl. No.: 12/846,816

(22) Filed: Jul. 29, 2010

(65) Prior Publication Data

US 2012/0024218 A1 Feb. 2, 2012

(51) Int. Cl.
*B63B 35/71* (2006.01)
*B63B 7/08* (2006.01)

(52) U.S. Cl.
USPC ..... 114/347; 114/354

(58) Field of Classification Search ..... 114/361, 114/363, 353, 354, 352, 360, 347, 343, 345; 441/35, 38, 40, 41
See application file for complete search history.

(56) References Cited

U.S. PATENT DOCUMENTS 1,736,155 A * 11/1929 Harter ..... 114/354
2,334,072 A * 11/1943 Cooper ..... 114/345
2,338,976 A * 1/1944 Schutte ..... 114/354
4,751,889 A * 6/1988 Pool ..... 114/39.32
5,964,178 A * 10/1999 Gonda ..... 114/354
6,314,904 B1 * 11/2001 Elvestad ..... 114/347
6,353,969 B1 * 3/2002 LeMole ..... 16/352
6,371,042 B1 * 4/2002 Abernethy et al. ..... 114/354
6,539,889 B2 * 4/2003 Simpson ..... 114/345
6,623,322 B1 * 9/2003 Lesniak ..... 441/38
7,021,233 B2 * 4/2006 Hall et al. ..... 114/347
8,091,502 B2 * 1/2012 Haller ..... 114/345
2006/0075955 A1 * 4/2006 DeChant ..... 114/345

* cited by examiner

*Primary Examiner* — Lars A Olson
*Assistant Examiner* — Andrew Polay
(74) *Attorney, Agent, or Firm* — Lowe Graham Jones PLLC

(57) ABSTRACT

A hybrid inflatable kayak is configured to rival the handling and speed of skin-on-frame or hard-shell kayaks, while simplifying the assembly and disassembly process. The hybrid inflatable kayak includes an internal frame assembly that cooperates with inflatable bladders and inflatable thwarts giving the kayak an improved watershed capacity and also an improved combination of weight, stability, speed, structural strength, and portability. The internal frame assembly includes a bow rib, a stern rib, and a number of frame members that attach together and extend lengthwise from bow to stern. Front and rear thwarts are inflatable and urge against the frame members and side bladders to put the frame members in tension, make the outer cover sufficiently taut, and provide a faster and more structurally robust design.

22 Claims, 5 Drawing Sheets

HYBRID INFLATABLE KAYAK

FIELD OF THE INVENTION

This invention relates generally to a hybrid kayak, and more specifically to a hybrid inflatable kayak having inflatable bladders and thwarts that cooperate with a rigid kayak frame assembly.

BACKGROUND OF THE INVENTION

A kayak is a small human-powered boat that traditionally has a covered deck, and one or more cockpits, each seating one paddler who strokes a double-bladed paddle. The cockpit is generally covered by a spraydeck that keeps the inside of the boat and the paddler's lower body dry. The spraydeck or similar waterproof covering attaches securely to the edges of the cockpit, preventing the entry of water from waves or spray, and making it possible, in some boats, to roll the kayak, capsizing and righting the boat without it filling with water or ejecting the passenger.

Kayak hulls are categorized according to the shape from bow to stern; common shapes include (1) symmetrical—the widest part of the boat is halfway between bow and stern; (2) fish—the widest part is forward of the midpoint and (3) Swedish—the widest part is aft of the midpoint.

An inflatable kayak, also known as a ducky, can usually be transported by hand using a carry bag. An outer skin, cover or shell of a conventional inflatable kayak may be made from hypalon (a kind of neoprene), a polyvinyl chloride fabric, or a polyurethane coated cloth. They can be inflated with foot, hand, or electric pumps. Multiple air compartments increase safety.

Until recently, inflatable kayaks were non-rigid, essentially pointed rafts, and best suited for use on rivers and calm water. However, some manufacturers have provided inflatable bladders captured inside non-stretch material, such as the coated cloth. Vessel rigidity increased, to a point. While portability is still adequate with these kayaks, the craft still have limitations. For example, tracking and hull shape may be less than ideal. Some hybrid kayaks with inflatable bladders and frames have been attempted. However, an adequate balance between weight, stability, speed, structural strength, and portability is somewhat elusive.

SUMMARY OF THE INVENTION

In at least one embodiment of the present invention, a hybrid inflatable kayak includes an internal frame assembly that cooperates with inflatable bladders, including inflatable thwarts to address at least some of the drawbacks discussed above. In one embodiment, the hybrid inflatable kayak includes side bladders located adjacent to at least some portions of an internal frame assembly. Forward and aft inflatable thwarts, upon inflation, press outwardly on the side bladders and frame assembly to provide a taut hull shape of the kayak. The thwarts may also function as a foot brace and a backrest, respectively.

In one aspect of the invention, a kayak includes an outer cover; a frame assembly located in the outer cover, the frame assembly having a plurality of elongated structural members oriented from bow to stern; inflatable bladders positioned along each side of the kayak and positioned proximate to the structural members; an inflatable front thwart located forward of a kayak seat; and an inflatable rear thwart located rearward of the seat. Inflating the thwarts generates pressure on the bladders and frame members to make the outer cover taut and the entire craft firm and at least semi-rigid.

In another aspect of the invention, a method of assembling a kayak includes the steps of (1) connecting frame members of a frame assembly, at least one pair of frame members spaced apart from each other and both extending lengthwise down the kayak; (2) arranging the frame members in an outer cover of the kayak; (3) inflating bladders extending substantially along each side of the kayak and positioned proximate to the frame members; (4) positioning fore and rear thwarts in the outer cover; and (5) inflating fore and rear thwarts sufficient to press the thwarts against the bladders and frame members and make the outer cover taut.

In yet another aspect of the invention, a kayak includes an outer cover; a frame assembly located in the outer cover, the frame assembly having a plurality of elongated frame members arranged lengthwise from bow to stern; a plurality of couplings located between adjacent frame members, the couplings attachable to the frame members to permit the frame members to be placed under tension; inflatable bladders positioned along each side of the kayak and positioned proximate to the frame members; an inflatable front thwart located forward of a kayak seat; and an inflatable rear thwart located rearward of the seat. Inflation of the thwarts advantageously tensions the frame members to generate a desired hull shape for the outer cover of the kayak and desired rigidity of the kayak.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENTS

The present invention includes a hybrid inflatable kayak designed to rival the handling and speed of skin-on-frame or hard-shell kayaks, while simplifying the assembly and disassembly procedure. The hybrid inflatable kayak includes an internal frame assembly that cooperates with inflatable bladders and inflatable thwarts to provide a high-performance, internal frame assembly while giving the kayak an improved watershed capacity and also providing an improved combination of weight, stability, speed, structural strength, and portability as described in greater detail below.

Figure 1:
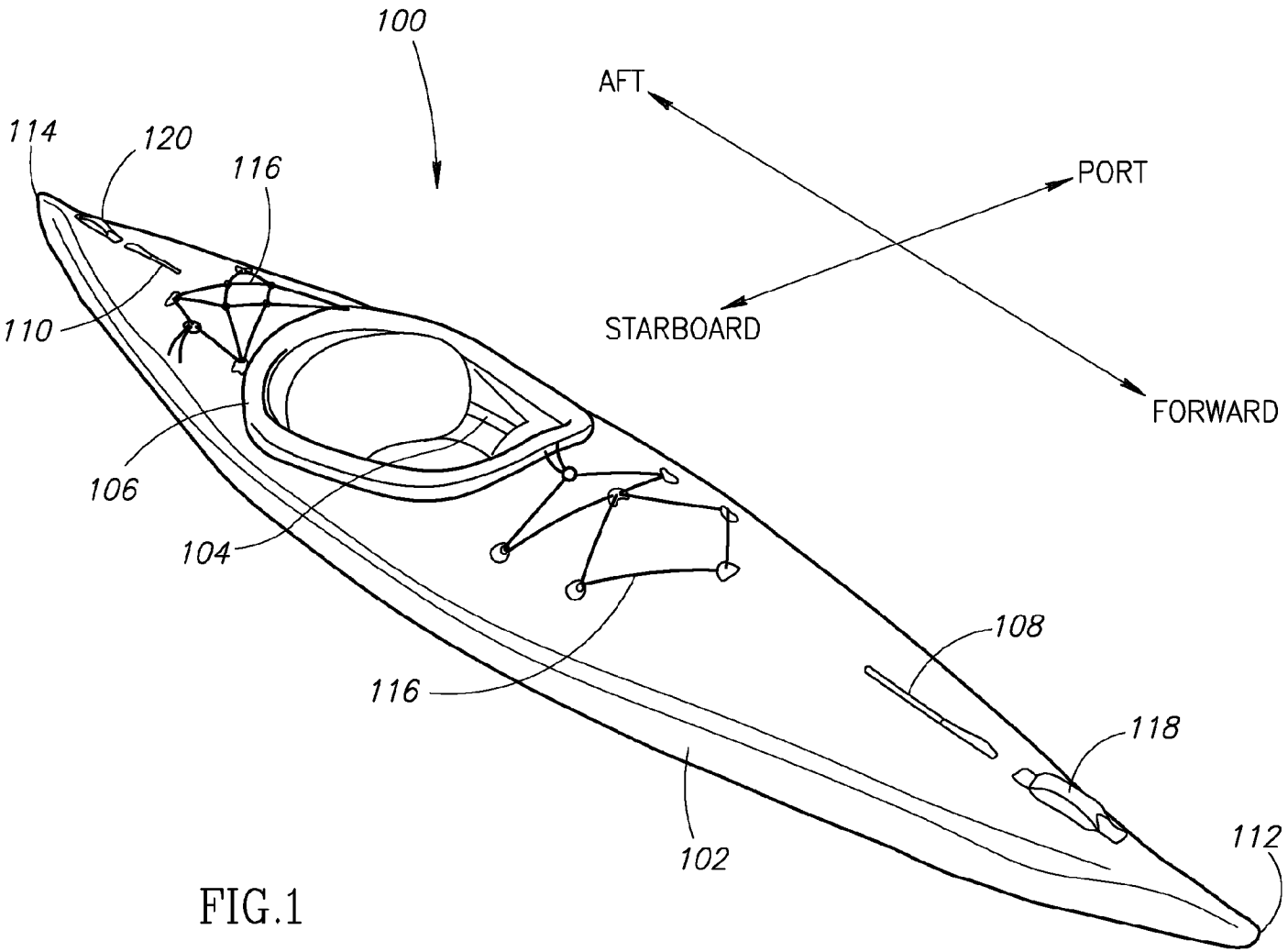
FIG. 1 is a perspective view of a kayak having inflatable side bladders and thwarts that cooperated with a kayak frame assembly according to an embodiment of the present invention.

FIG. 1 shows a hybrid inflatable kayak 100 having an outer cover 102 that extends from bow to stern and from port to starboard. A cockpit 104 arranged near a mid section of the kayak 100 and may include inflatable coaming 106 for attachment of a spray skirt (not shown). The outer cover 102 taut over an internal frame assembly and over various inflatable devices, all of which are described in more detail below. In one embodiment, the outer cover 102 is made from heavy-duty polyvinyl chloride tarpaulin that provides a desired amount of puncture resistance. The kayak 100 may include front and aft zippable access regions 108, 110 for below deck storage and for gaining access to any components located within the outer cover 102. In addition, the kayak may optionally include molded front and aft end caps 112, 114, bungee deck lacing 116 and front and aft tote handles 118, 120. In the illustrated embodiment, it is appreciated that the hull shape, cockpit location and other features may be varied depending on how the kayak is intended to be used.

Figure 2A:
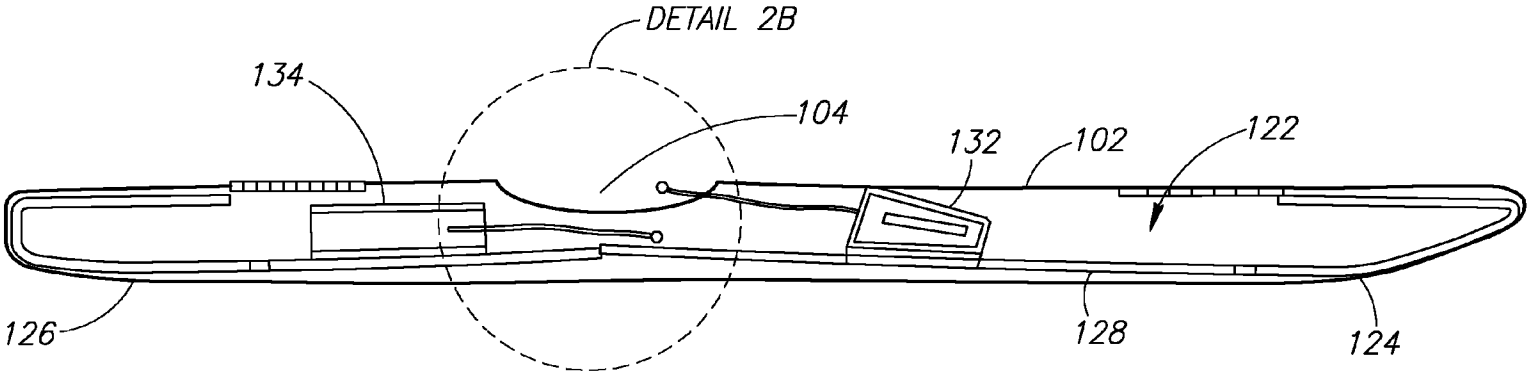
FIG. 2A is a bow-to-stern cross-sectional view of the kayak of FIG. 1 showing bottom frame members of the frame assembly according to an embodiment of the present invention.
Figure 2B:
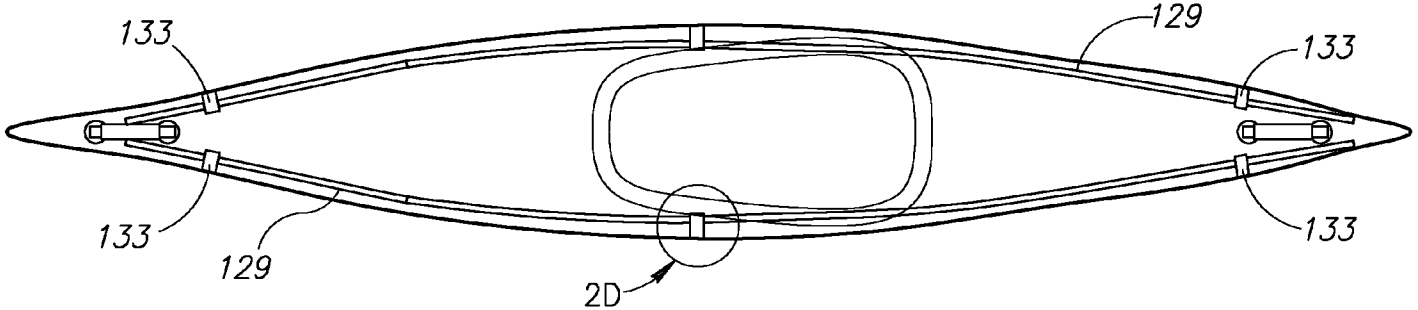
FIG. 2B shows a detailed view of a locking sleeve 130 for attaching together the bottom frame members of the frame assembly of FIG. 2A.
Figure 2C:
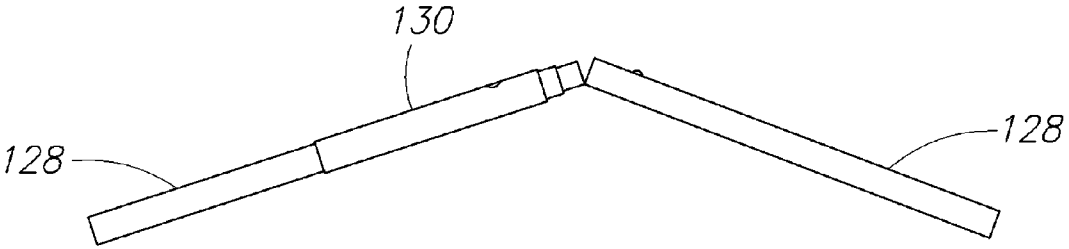
FIG. 2C is a top, cross-sectional view of the kayak of FIG. 1 showing side members of the frame assembly according to an embodiment of the present invention.
Figure 2D:
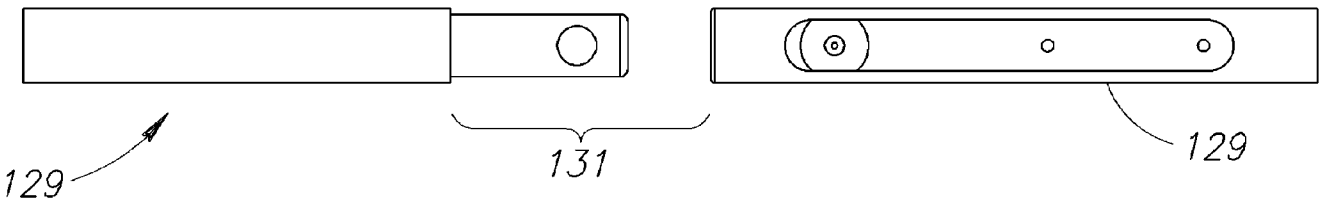
FIG. 2D shows a detailed view of a detent-type coupling member for attaching together the side frame members of the frame assembly of FIG. 2C.

FIG. 2A shows the internal frame assembly 122 arranged within the outer cover 102. The internal frame assembly 122 includes a bow rib 124, a stern rib 126 and a plurality of elongated frame members 128 that extend from the bow rib 124 to the stern rib 126 at least along a floor and/or side region of the kayak 100. The internal frame assembly 122 may further include side member 129 as best shown in FIG. 2B. The side members 129 may optionally connect to the bow rib 124 and stern rib, 126, respectively, or may be structurally independent therefrom. The ribs 124, 126, elongated frame members 128 and side members 129 may be assembled in sections similar to tent poles and preferably include structural couplings. By way of example, the elongated frame member may be connected together using an interconnection such as locking sleeves 130 (FIG. 2C) between the sections; whereas the side members may be connected together using a detent-type coupling 131 (FIG. 2D). In one embodiment, the locking sleeves 130 include threaded end portions or some other mechanical locking equivalent and the couplings may take the form of biased or spring-loaded, push-button type couplings. The ribs 124, 126, elongated frame members 128, and side members 129 may take the form of hollow poles made from a lightweight, strong material, such as, but not limited to, aluminum or high-strength fiber reinforced composites. The ribs 124, 126, the elongated frame members 128, and side members 129 may be coupled to the outer cover 102 with an interconnection formed by straps, clips or other attachment means 133 (FIG. 2D). The interconnections have differing rigidities, including a first and second rigidity different from the first rigidity.

Referring back to FIG. 2A, a forward inflatable thwart 132 is located in front of the cockpit 104 and an aft inflatable thwart 134 is located behind the cockpit 104. The thwarts 132, 134 operate as inflatable crossbeams or braces that extend widthwise across the hull to increase hull strength. Further, the front thwart 132 may function as a foot brace or support while the rear thwart 134 may function as a backrest or to help support a backrest pad in the cockpit 104. The thwarts 132, 134, once inflated, urge the frame members 128 in a downward direction while urging the side members 129 in an outward direction to place them in tension or alternatively increase the tension in the respective members. Additional thwarts (not shown) may also be included, as necessary.

Figure 3:
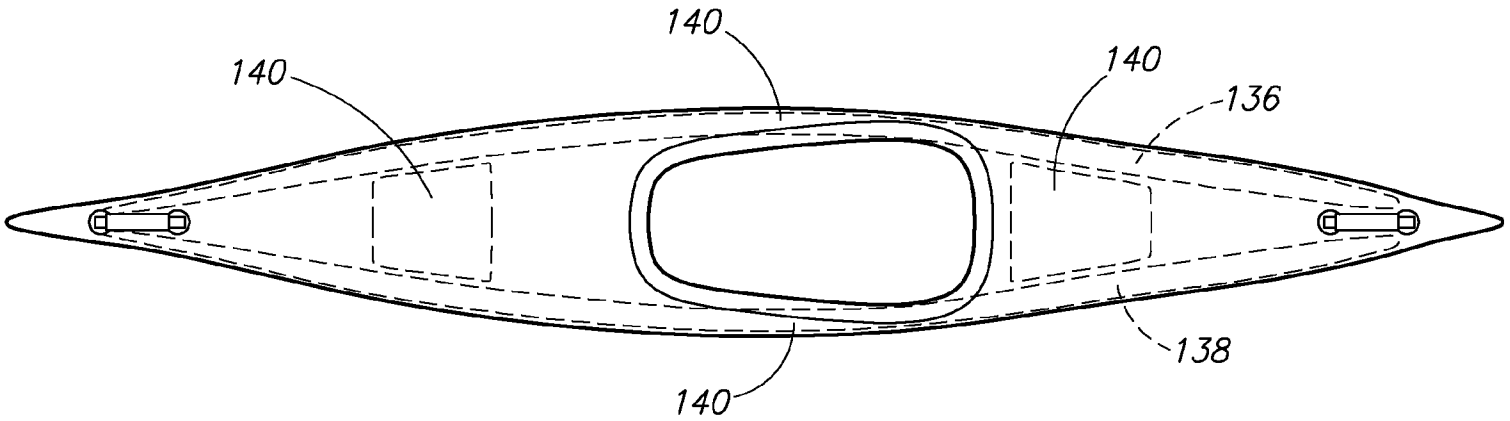
FIG. 3 is top plan view of the kayak of FIG. 1 showing both forward and rear thwarts according to an embodiment of the present invention.

Referring now to FIG. 3, the thwarts 132, 134 push or press against inflatable side bladders 136, 138 arranged along the sides of the kayak 100. In one embodiment, the side bladders 136, 138 extend substantially from bow to stern. In another embodiment, the side bladders may take the form of multiple bladders that are independently inflatable. The side bladders 136, 138 may be integrally molded with the outer cover 102.

Inflation of the thwarts 132, 134 places the outer cover 102 into a taut configuration as it puts pressure on the side bladders 136, 138, frame members 128, and side members 129. Moreover, inflation of the thwarts 132, 134 spreads the side members 129 and may lift the deck of the kayak 100 for improved watershed capability and to help define the shape of the hull. The thwarts 132, 134 and the side bladders 136, 138 may have one or more inflation ports 140, which may take the form of a twist valve, a Boston valve, or another type of sealable valve.

Figure 4:
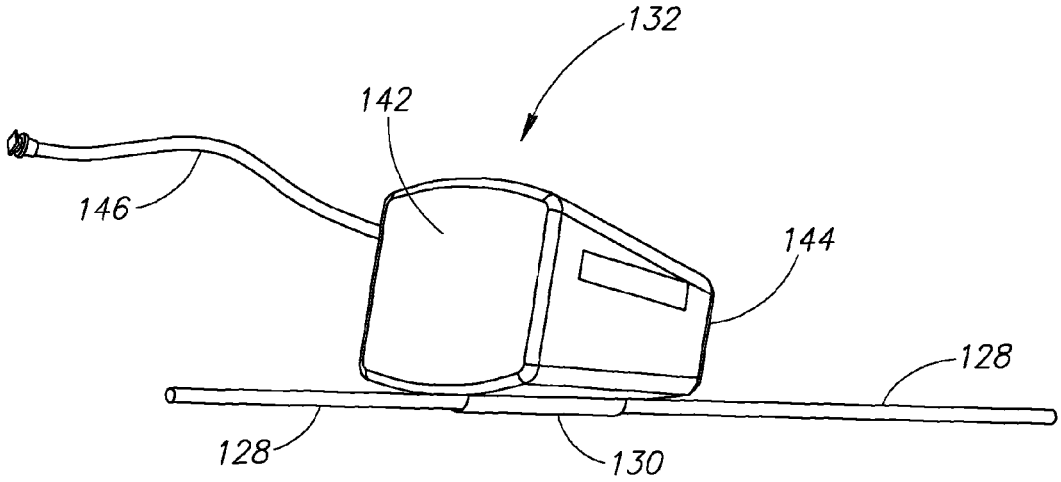
FIG. 4 is a perspective view of a front thwart according to an embodiment of the present invention.

FIG. 4 shows the front thwart 132 positioned proximate to one of the frame members 128. In the illustrated embodiment, the front thwart 132 includes a tapered contour in which the larger tapered end 142 faces toward the cockpit 104 (FIG. 1) while the smaller tapered end 144 faces toward the bow rib 124 (FIG. 2A). It is appreciated that the shape of the front thwart 132 is not limited to the illustrated, tapered shape, but instead it may take a variety of other shapes. The front thwart 132 may include a flexible inflation tube 146 that is long enough to be accessible from the cockpit 104 (FIG. 1). In one embodiment, the flexible inflation tube 146 is detachable after inflation of the front thwart 132.

Figure 5:
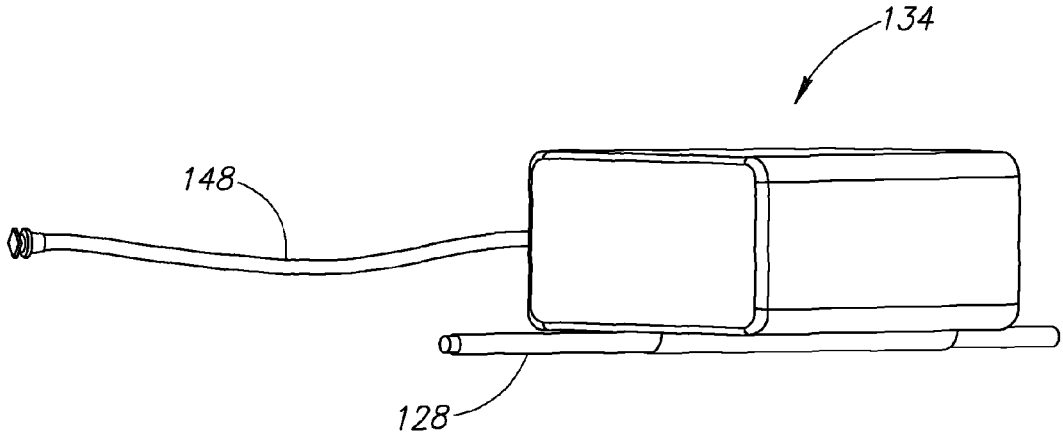
FIG. 5 is a perspective view of an rear thwart according to an embodiment of the present invention.

FIG. 5 shows the rear thwart 134 positioned proximate to another frame member 128. In the illustrated embodiment, the rear thwart 134 takes more of a square or rectangular shape. As noted above with respect to the front thwart 132, it is appreciated that the shape of the rear thwart 134 is not limited to the illustrated shape, but instead it may take a variety of other shapes. The rear thwart 134 may include a separate flexible inflation tube 148 that is long enough to be accessible from the cockpit 104 (FIG. 1). In one embodiment, the flexible inflation tube 148 is the same as the detachable tube 146 described above for the front thwart 132. Both the forward and rear thwarts 132, 134 may be sized to achieve a desired hull style, and in turn permit the kayak 100 to handle more like a conventional hard-shell kayak.

The kayak 100, as described above as well as various embodiments thereof, may advantageously bridge the performance gap between conventional hard shell kayaks and purely inflatable kayaks. For example, the hybrid inflatable kayak 100 may accommodate higher hull speeds that are comparable to hard shell kayaks while also being highly portable over land (e.g., by vehicle), sea (e.g., by boat) or air (e.g., by plane). Further, the kayak 100 may advantageously have fewer frame members because the inflatable thwarts structurally cooperate with the side bladders and frame members. In addition, the kayak 100 may be assembled or disassembled faster than other existing inflatable or hybrid kayaks.

While the preferred embodiments of the invention have been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The embodiments of the invention in which an exclusive property or privilege is claimed are defined as follows:

1. A boat comprising:

an outer cover having a first rigidity;

a frame assembly located in the outer cover, the frame assembly having a plurality of elongated structural members oriented from bow to stern, the frame assembly having a second rigidity greater than the first rigidity;

an interconnection between at least two of the elongated structural members, wherein the interconnection includes a portion of the outer cover, wherein the interconnection has a rigidity less than the second rigidity, and wherein the interconnection is the only coupling between the two elongated structural members;

inflatable bladders positioned along each side of the boat and positioned proximate to the structural members;

an inflatable front thwart located forward of a kayak seat;

a cover over a top of the inflatable front thwart; and an inflatable rear thwart located rearward of the seat and extending between the inflatable bladders positioned along each side of the boat, wherein sufficiently inflating the thwarts generates pressure on the bladders and structural members to make the outer cover taut.

2. The boat of claim 1, wherein the frame assembly includes a bow rib distally located from a stern rib.

3. The boat of claim 1, wherein the frame members couple to and extend between the bow and stern ribs.

4. The boat of claim 1, wherein the frame members are tubular.

5. The boat of claim 1, wherein the inflatable bladders are attached to the outer cover.

6. The boat of claim 1, further comprising an access region located in the outer cover.

7. The boat of claim 1, wherein the front thwart provides a foot brace once inflated, the front thwart extending between the inflatable bladders positioned along each side of the boat.

8. The boat of claim 1, wherein the rear thwart provides a back rest once inflated.

9. The boat of claim 1, wherein the inflated bladders and thwarts cooperate with the frame assembly to provide a desired contour and rigidity for a hull of the boat.

10. A method of assembling a kayak, the method comprising:

connecting frame members of a frame assembly, at least one pair of frame members spaced apart from each other and both extending lengthwise down the kayak;

arranging the frame members in an outer cover of the kayak;

inflating bladders extending substantially along each side of the kayak and positioned proximate to the frame members;

positioning fore and rear thwarts in the outer cover with a portion of the outer cover extending over a top of at least one of the fore and rear thwarts;

inflating fore and rear thwarts sufficient to press the thwarts against the bladders and frame members and make the outer cover taut;

collapsing the frame members by releasing pressure from the fore or rear thwart, wherein collapsing the frame members comprises releasing the frame members to permit the outer cover to be folded; and folding the outer cover.

11. The method of claim 10, wherein connecting the frame members includes connecting elongated frame poles to bow and stern ribs.

12. The method of claim 10, inflating bladders includes pressurizing bladders that are integrally molded with the outer cover.

13. The method of claim 10, wherein inflating the fore and rear thwarts includes increasing the spaced apart distance between the pair of frame members.

14. The method of claim 10, wherein positioning the front thwart includes positioning the front thwart to be used as a foot brace by a kayaker.

15. The method of claim 10, wherein positioning the rear thwart includes positioning the rear thwart to be used as a backrest by a kayaker.

16. The method of claim 10, wherein positioning the fore and rear thwarts includes inserting the fore and rear thwarts into the outer cover through respective openings provided in a deck of the kayak.

17. A kayak comprising:

an outer cover;

a frame assembly located in the outer cover, the frame assembly having a plurality of elongated frame members arranged lengthwise generally from bow to stern;

a plurality of couplings located between adjacent frame members, the couplings attachable to the frame members to permit the frame members to be placed under tension;

inflatable bladders positioned along each side of the kayak and positioned proximate to the frame members;

an inflatable front thwart located forward of a kayak seat and extending between the inflatable bladders along the side of the kayak;

an inflatable rear thwart located rearward of the seat and extending between the inflatable bladders along the side of the kayak; and a flexible inflation hose attachable to at least one of the thwarts such that the thwart is inflatable from a cockpit of the kayak;

wherein inflating the thwarts tensions the frame members to generate a desired hull shape for the outer cover of the kayak.

18. The kayak of claim 17, wherein the outer cover is made from a puncture resistant material.

19. The kayak of claim 17, wherein the couplings attach to the frame member using a biased, push-button detent system.

20. A boat comprising:

an outer cover having a first rigidity;

a frame assembly located in the outer cover, the frame assembly having a plurality of elongated structural members oriented from bow to stern, the frame assembly having a second rigidity greater than the first rigidity;

an interconnection between at least two of the elongated structural members, wherein the interconnection includes a portion of the outer cover, wherein the interconnection has a rigidity less than the second rigidity, and wherein the interconnection is the only coupling between the two elongated structural members;

inflatable bladders positioned along each side of the boat and positioned proximate to the structural members;

an inflatable front thwart located forward of a kayak seat;

an inflatable rear thwart located rearward of the seat and extending between the inflatable bladders positioned along each side of the boat, wherein sufficiently inflating the thwarts generates pressure on the bladders and structural members to make the outer cover taut; and an upper frame member over a central region of the inflatable front thwart when viewed from above and a lower frame member below the inflatable front thwart.

21. The boat of claim 1 wherein the frame assembly further comprises side frame members positioned adjacent to the sides of the thwarts.

22. The boat of claim 1 wherein the frame assembly has a central frame member extending from bow to stern, and wherein at least one of the front or rear thwarts exerts downward pressure on the central frame assembly.

* * * * *